US006363312B1

(12) United States Patent
Griffin

(10) Patent No.: US 6,363,312 B1
(45) Date of Patent: Mar. 26, 2002

(54) METHOD AND APPARATUS FOR DETERMINING THE A/F RATIO OF AN INTERNAL COMBUSTION ENGINE

(75) Inventor: Joseph R. Griffin, Fenton, MI (US)

(73) Assignee: Heraeus Electro-Nite International N.V., Houthalen (BE)

( * ) Notice: Subject to any disclaimer, the term of this patent is extended or adjusted under 35 U.S.C. 154(b) by 0 days.

(21) Appl. No.: 09/574,934

(22) Filed: May 19, 2000

Related U.S. Application Data

(60) Provisional application No. 60/141,390, filed on Jun. 29, 1999.

(51) Int. Cl.[7] ..... F02D 41/14

(52) U.S. Cl. ..... 701/103; 123/676; 73/117.3

(58) Field of Search ..... 701/102, 103; 123/676; 73/117.3

(56) References Cited

U.S. PATENT DOCUMENTS

| | | | | |
|---|---|---|---|---|
| 4,305,364 A | 12/1981 | Stuckas | 123/676 |
| 4,617,794 A | 10/1986 | Fujitani et al. | 60/274 |
| 4,656,829 A | 4/1987 | Creps et al. | 60/277 |
| 5,050,376 A | 9/1991 | Stiglic et al. | 60/274 |
| 5,303,168 A | 4/1994 | Cullen et al. | 700/299 |
| 5,414,994 A | 5/1995 | Cullen et al. | 60/274 |
| 5,722,236 A | 3/1998 | Cullen et al. | 60/274 |
| 5,832,721 A | 11/1998 | Cullen | 60/274 |

FOREIGN PATENT DOCUMENTS

| | | | | |
|---|---|---|---|---|
| DE | 3204842 A1 | | 8/1983 | |
| EP | 0 735 257 A2 | | 10/1996 | |
| JP | 58-98637 A | * | 6/1983 | F02D/33/00 |
| JP | 60-90940 A | * | 5/1985 | 123/445 |
| WO | WO 96/35049 | | 11/1996 | |

* cited by examiner

*Primary Examiner*—Andrew M. Dolinar
(74) *Attorney, Agent, or Firm*—Akin, Gump, Strauss, Hauer & Feld, L.L.P.

(57) ABSTRACT

A method is disclosed for using a computer for determining an air-to-fuel (A/F) ratio of an internal combustion engine in which information characteristic of the engine relating the A/F ratio of the engine, the exhaust gas temperature of the engine, the speed of the engine and a parameter related to the load of the engine is previously stored in the computer. The method comprises the steps of: measuring the exhaust gas temperature of the engine; measuring the speed the speed of the engine; measuring the parameter related to the load of the engine; computing the A/F ratio based on the previously stored information, the measured exhaust gas temperature, the measured speed and the measured parameter related to the load; and outputting a signal representative of the A/F ratio.

13 Claims, 6 Drawing Sheets

METHOD AND APPARATUS FOR DETERMINING THE A/F RATIO OF AN INTERNAL COMBUSTION ENGINE

CROSS REFERENCE TO RELATED APPLICATIONS

This application claims the benefit of U.S. Provisional Application No. 60/141,390, filed Jun. 29, 1999, entitled High Driveability Index Fuel Detection by Exhaust Gas Temperature Measurement.

BACKGROUND OF THE INVENTION

The present invention relates to internal combustion engines and more particularly, to a method and apparatus for determining the air-to-fuel ratio of an internal combustion engine based upon a measurement of the exhaust gas temperature of the engine.

Approaches for reducing undesired emissions in the exhaust gas of internal combustion engines include: (1) operating the engine with engine operating parameters specifically set to minimize the engine generated undesired emissions measured at the engine exhaust manifold, and (2) employing after-treatment of the engine exhaust gas and adjusting the engine operating parameters to minimize the undesired emissions measured at the tailpipe outlet.

In the case of engines used in part-throttle applications such as automobiles, it is the current practice to employ a three-way catalytic converter for after-treatment of the engine exhaust gas. A three-way catalytic converter operating with engine exhaust gas having a stoichiometric air-to-fuel (A/F) ratio of 14.7 is extremely effective in reducing CO, HC and $NO_X$ tailpipe emissions. However, in order to achieve the maximum reduction of undesired tailpipe emissions, the A/F ratio of the engine exhaust gas must be tightly controlled to a value of 14.7.

Switching type exhaust gas oxygen (EGO) sensors mounted in the engine exhaust path of automotive exhaust systems are commonly used to provide an indication of whether the A/F ratio of the engine exhaust gas is above or below the desired exhaust gas A/F ratio of 14.7. Switching type EGOs are sensitive, accurate, inexpensive, rugged and well matched to providing the tightly controlled exhaust gas A/F ratio required by catalytic converters. Automobile emission control systems used with fuel injected internal combustion engines typically employ one or more EGOs in a closed loop control system to regulate the A/F ratio to an average value of 14.7 by adjusting the engine fuel injection period for each cylinder event.

After automotive emissions, the next most serious source of air pollution from internal combustion engines in the United States are the gasoline powered internal combustion engines that power lawn mowers. Accordingly, it is desirable to reduce the undesired emissions from lawn mowers.

Internal combustion engines such as those used in lawn mowers (and also marine vessels) operate under continuous high load conditions. These engines typically operate with a rich A/F ratio (i.e. an A/F ratio substantially less than 14.7) in order to yield maximum power from the engine simultaneously with low engine weight and acceptable cooling of the engine. Engine operation at other than an A/F ratio of 14.7 precludes using a three-way catalytic converter for after-treatment of engine exhaust gas. Accordingly means for reducing the undesired emissions from the engines that power lawn mowers and similar engines must do so without the benefit of a three-way catalytic converter.

Engine cooling is critical for engines operating at full load such as those used to power lawn mowers and marine vessels. The cooling of an internal combustion engine increases as the A/F ratio is decreased below 14.7. However, CO and HC emissions increase rapidly as the A/F ratio decreases below the value of 14.7.

In lawnmower and marine applications, for example, it is common practice to preset the A/F ratio of new engines to a predetermined rich value dictated by the engine power output and the cooling requirements, without the benefit of closed loop A/F ratio control. It is well known that a preset engine A/F ratio gradually drifts to a higher value of A/F ratio as the engine wears. Accordingly, it is common practice to preset the A/F ratio of new engines designed for operating under high load conditions to a value that is lower than is necessary for acceptable engine cooling and power, to ensure that adequate engine cooling will be maintained over the life of the engine. Since the A/F ratio is commonly set lower than necessary for acceptable engine operation during much of the life of the engine, the undesired emissions generated by the engine are higher than they would otherwise be if the A/F ratio could be maintained to be more optimum during the engine lifetime.

If the actual A/F ratio of the engine exhaust gas could be directly measured, engines operating with a rich A/F ratio could be controlled by a closed loop control system to set and hold a higher value of A/F ratio than is now commonly employed, thereby maintaining acceptable operating performance and simultaneously reducing undesired CO and HC engine emissions. However, switching type EGO sensors, as used in automotive applications, are only suitable for measuring the exhaust gas A/F ratio when the A/F ratio is centered on a value of 14.7. The only alternative thus found that is practical for accurately measuring the A/F ratio of an operational internal combustion engine is a universal exhaust gas oxygen (UEGO) sensor. However, the UEGO sensor has been found to be too expensive for applications such as a lawnmower motor, and to be unreliable when exposed to water such as would occur in marine applications. Consequently, engines used to power lawnmowers and marine vessels typically operate without the benefit of closed loop control of the engine exhaust A/F ratio.

A number of investigators have developed methods for computing the temperature of engine exhaust gas and/or the temperature of the catalytic converter in automotive applications. These methods have in common, computing the exhaust gas and the catalytic converter temperatures based on a measurement of the exhaust gas A/F ratio. For example, U.S. Pat. No. 4,656,829 teaches an analytical method of computing the catalytic converter temperature based on the exhaust gas A/F ratio, mass air flow and empirical data characteristic of a specific engine/catalytic converter combination. Similarly, U.S. Pat. No. 5,303,168 discloses a method of computing the engine exhaust temperature based on the A/F ratio, exhaust gas recirculation (EGR) rate, spark timing, the mass air flow and the engine speed. Thus, it has been suggested that there is a predictable relationship between the A/F ratio of an engine and the exhaust gas temperature of an engine.

While it has been suggested that a relationship exists between the engine exhaust A/F ratio and the engine exhaust gas temperature, previously developed models representing the A/F ratio/exhaust gas temperature relationship have all been for part-throttle applications such as used in vehicles employing catalytic converters, in which the engine is operating under stoichiometric conditions. Further, each of the aforementioned models computes the exhaust gas temperature from a measured A/F ratio, and requires, in addition to measuring the A/F ratio, extensive other sensor inputs such as mass air flow. None of these known methods discloses or teaches the reverse process of determining the A/F ratio from a set of engine measurements under non-stoichiometric conditions. Accordingly, there is a need for a means for accurately determining the A/F ratio of internal combustion engines operating with rich A/F ratios under sustained high power conditions such as, for example, the type of engines used on lawnmowers and in marine vessels and which relies exclusively on inexpensive and reliable sensors.

BRIEF SUMMARY OF THE INVENTION

In brief the present invention comprises a method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer. The method comprises the steps of: measuring the exhaust gas temperature, the speed, and the parameter related to the load; computing the A/F ratio based on the previously stored information, the measured exhaust gas temperature, the measured speed and the measured parameter related to the load; and outputting a signal representative of the A/F ratio.

The present invention also comprises a system for determining an air-to-fuel (A/F) ratio of an internal combustion engine. The system comprises a memory for storing information characteristic of the engine relating the A/F ratio, the exhaust gas temperature, the speed and a parameter related to the load of the engine; a sensor for measuring the exhaust gas temperature of the engine; a sensor for measuring the speed of the engine; a sensor for measuring the parameter related to the load of the load of the engine; and a computer for determining the A/F ratio from a computation based on the stored engine information, the measured exhaust gas temperature, the measured engine speed and the measured parameter related to the engine load and for outputting a signal representative of the A/F ratio.

The present invention further comprises computer executable software code stored on a computer readable medium for computing an air-to-fuel (A/F) ratio of an internal combustion engine. The software code comprises: information characteristic of the engine relating the A/F ratio, the exhaust gas temperature, the engine speed and the parameter related to the engine load; code responsive to receiving a measurement of the exhaust gas temperature of the engine; code responsive to receiving a measurement of the engine speed; code responsive to receiving a measurement of the parameter related to the engine load; and code for computing the A/F ratio based on the measured exhaust gas temperature, the measured engine speed, the measured parameter related to the engine load; and the information relating the A/F ratio, the engine exhaust gas temperature, the engine speed and the parameter related to the engine load.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
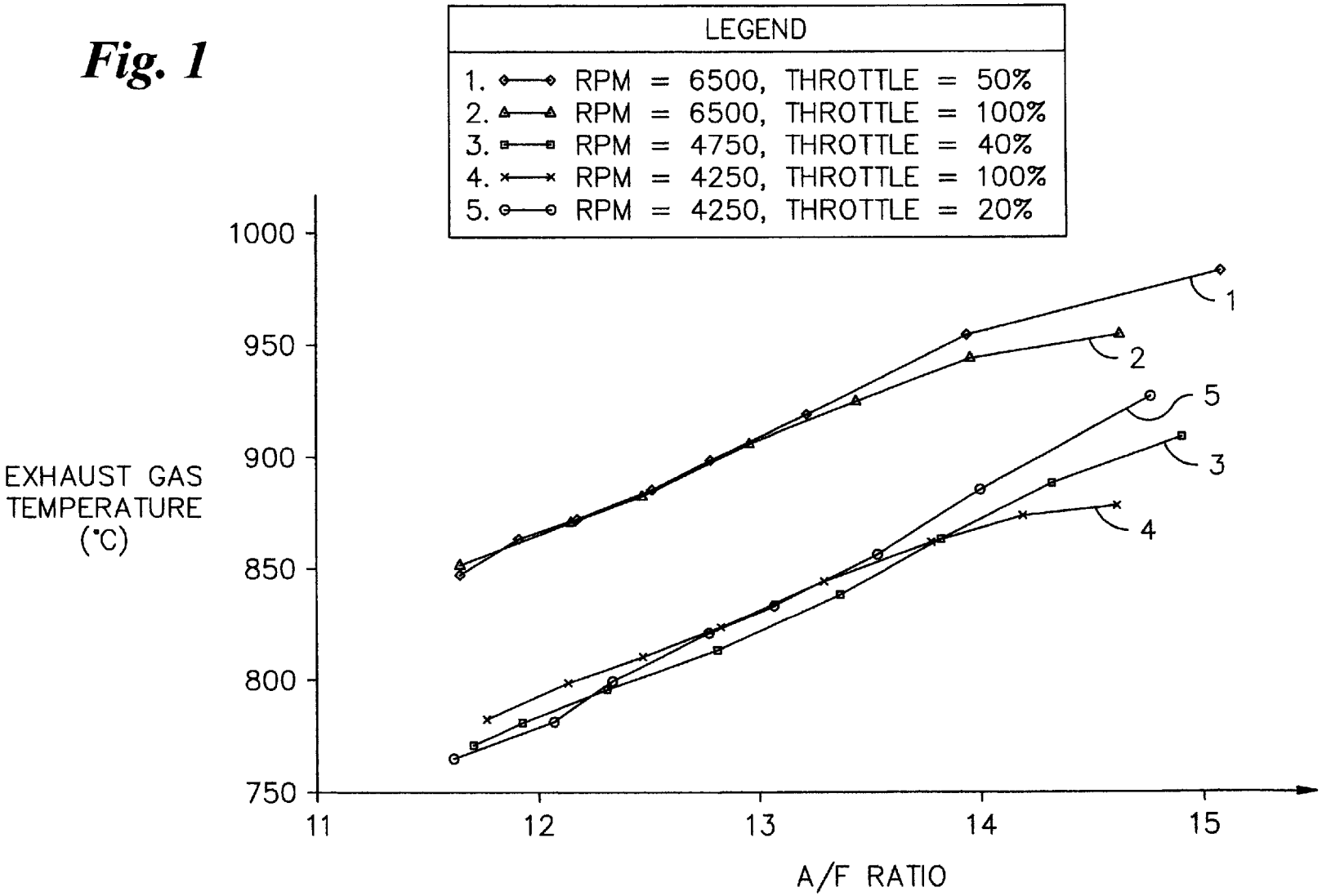
FIG. 1 is a graph showing the relationship of air-to-fuel ratio and exhaust gas temperature for different values of throttle position and engine speed.

Referring to the drawings, where like numerals are used to indicate like elements throughout there is shown in FIG. 1 the results of a series of experiments conducted on a 500 cc gasoline engine for collecting information characteristic of the operation of the engine. The data shown in FIG. 1 demonstrates a single valued relationship between air-to-fuel (A/F) ratio, exhaust gas temperature, speed and throttle position of an internal combustion engine over a range of the A/F ratio exceeding 12:1 to 14:1.

Figure 2:
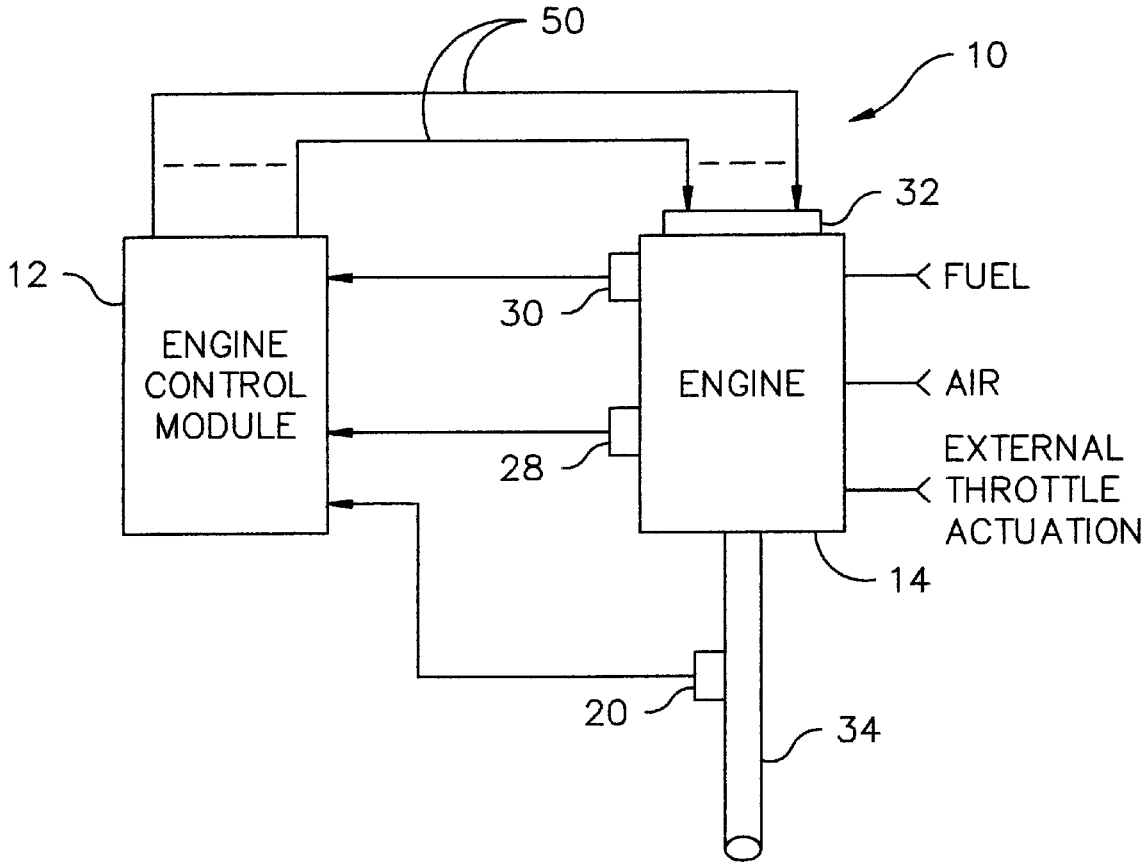
FIG. 2 is schematic block diagram of a preferred embodiment of a system for controlling the A/F ratio of an internal combustion engine according to the present invention.

Referring now to FIG. 2, there is shown a schematic block diagram of a preferred embodiment of a system 10 for determining the A/F ratio of the internal combustion engine 14 based on information characteristic of the engine 14, such as shown in FIG. 1, which has been previously stored in the system 10, and on measurements of the exhaust gas temperature, the speed and the throttle position of the engine 14.

In the preferred embodiment of the system 10, the engine 14 uses gasoline as fuel and is operated with a rich mixture of the gasoline and air, the mixture having an A/F ratio in the range of about 12 to 13, to achieve near maximum theoretical power output from the engine 14. The exhaust products from the engine 14 are delivered to the atmosphere by an exhaust system 34. The exhaust system 34 may include a muffler but typically does not include a pollution after-treatment device such as a catalytic converter. One skilled in the art will recognize that the system 10 is not limited to controlling engines operating within an A/F ratio of 12–13, or with a rich mixture or without after-treatment devices. For example, engines operating with lean A/F ratios are within the spirit and scope of the invention.

As will be known to those skilled in the art, there is an interdependency between engine speed, engine exhaust gas temperature and engine load. In the preferred embodiment, the engine load is determined by measuring a parameter related to the load such as the position of the throttle with a throttle position sensor (TPS) 28, the throttle position being particularly suited to measuring the load of small engines such as the engines used in lawn mowers. In the preferred embodiment, the TPS 28 is a resistive potentiometer, the wiper of the potentiometer being attached to the body of the throttle and rotating with the shaft of the throttle to signal the position of the throttle. As is well known to those skilled in the art, engine load may be determined from other parameters related to the load such as the output of sensors that measure: (1) the engine speed and the intake manifold air pressure; (2) the mass air flow in the intake manifold; (3) the position of the crankshaft; or (4) the ratio of compression to expansion stroke time duration of the engine. Accordingly, as will be appreciated by those skilled in the art, the invention is not limited to measuring the engine load by measuring the throttle position. Other methods for measuring the engine load as discussed above, may be used within the spirit and scope of the invention.

In the preferred embodiment, the engine speed is sensed by an engine speed sensor (ESS) 30. In the preferred embodiment, the ESS 30 is a Hall Effect device connected to the engine 14 camshaft. As will be appreciated by those skilled in the art, other types of engine speed sensors, such as a variable reluctance sensor, may be used to sense the speed of the engine 14, within the spirit and scope of the invention.

The preferred embodiment also includes an exhaust gas temperature sensor (EGTS) 20 connected to the exhaust system 34 for measuring the temperature of the gas exhausted by the engine 14 through the exhaust system 34. The EGTS 20 generates electrical output signals which are proportional to or representative of the instantaneous temperature of the exhaust gas. In the first preferred embodiment, the EGTS 20 is a Heraeus Sensor-Nite Model Number ECO-TS200s platinum resistive temperature detector sensor, which provides for a substantially linear change in resistance over a sensed temperature range of from 0 to 1,000° C. As will be appreciated by those skilled in the art, other types of temperature sensors from other manufacturers having suitable accuracy, stability and reliability could be used as the EGTS 20, within the spirit and scope of the invention.

In the preferred embodiment, the signal outputs from the throttle position sensor 28, the engine speed sensor 30 and the exhaust gas temperature sensor 20 are provided to an engine control module 12. In the preferred embodiment, the engine control module 12 includes a commercially available computer, the computer, including a central processing unit (CPU), volatile random access memory (RAM), non-volatile programmable read only memory (PROM) and analog-to-digital converter and digital-to-analog converter signal input/output components. The engine controller 12 stores computer executable software code, including the information characteristic of the engine, in the computer PROM. The computer executable software code controls the analog-to-digital converters in the controller 12 to receive input signals from the ESS, EGTS and TPS 20, 28, 30; processes the signals received from the analog-to-digital converters according to the software code and the stored information characteristics of the engine and generates an output signal representative of the A/F ratio of the engine 14.

As will be appreciated by those skilled in the art, the engine controller 12 is not limited to including a commercially available computer. For instance, the controller 12 could be implemented as hard coded logic elements constructed of discrete electronic components, as an application specific integrated circuit (ASIC) incorporating a stored computer program or hard wired logic or a combination of all of the above. Further, and as will be appreciated by those skilled in the art, the engine controller 12 need not be a separate device but could be a part of an existing electronic assembly used for other control functions, such assembly being programmed to support the A/F ratio control functions on a time shared basis.

In the preferred embodiment the output signal representative of the A/F ratio is used as a basis for closed loop control of the A/F ratio of the internal combustion engine 14. Accordingly, the A/F ratio output signal is compared in the computer with a selected one of a plurality of predetermined values of the A/F ratio which have been stored in the memory of the computer. An algebraic difference between the A/F ratio output signal and the selected one of the predetermined values of A/F ratio is used to generate the closed loop A/F ratio control signals 50 for control of A/F ratio actuators 32 attached to the engine 14. For engines equipped with fuel injection, the A/F ratio actuators 32 control the engine exhaust gas A/F ratio by adjusting the fuel injection period of the engine 14 for each cylinder event. The A/F ratio of engines equipped with carburetors is adjusted by bleeding air from the carburetor venturi using a purge valve.

In the first preferred embodiment, a first predetermined value of the A/F ratio is selected from the plurality of predetermined values when the exhaust gas temperature is less than or equal to a predetermined value, and a second predetermined value of A/F ratio is selected when the exhaust gas temperature is greater than the predetermined value. The first predetermined value of the A/F ratio is used for controlling the engine 14 when the engine is cold and the second predetermined value is to be used for controlling the engine 14 when the engine 14 is warm. The controller 12 controls the engine 14 to operate at either the first or the second predetermined A/F ratio by: accepting signals generated by the EGTS 20, the TPS 28 and the ESS 30; computing the A/F ratio based on the signals generated by the EGTS 20, the TPS 28 and the ESS 30 in combination with the information characteristic of the engine stored in the PROM; comparing the computed A/F ratio with either the first or second predetermined A/F ratio; generating an error signal, $\epsilon$, representing the algebraic difference between either the first or second predetermined values and the computed A/F ratio; and outputting the A/F ratio control signals 50 based on the error signal, $\epsilon$, to the engine actuators 32 controlling the engine A/F ratio, thereby minimizing the difference between the computed A/F ratio and either the first or the second predetermined A/F ratio.

In the preferred embodiment, the information about the engine that is stored in the PROM is a set of constants which represent characteristics of the engine 14 and are used as the coefficients of an empirically derived algebraic expression for computing the A/F ratio of the engine 14. The algebraic expression employed in the first embodiment is:

$$\begin{aligned}(A/F)_c = {} & -0.2060 - 0.035408 * TP - 0.0013878 * RPM + \\ & 0.06038 * EGT - 0.88682 * 10^{-4} * (EGT)^2 + \\ & 0.5015 * 10^{-7} * (EGT)^3 + 0.27743 * 10^{-4} * RPM * TP - \\ & 0.60241 * 10^{-10} * (RPM * TP)^2 + 0.50765 * 10^{-16} * (RPM * TP)^3,\end{aligned} \tag{1}$$

where $(A/F)_c$ is the computed A/F ratio, TP is the measured throttle position in percent of full throttle, EGT is the measured temperature of the exhaust gas in ° C. and RPM is the measured speed of the engine in revolutions per minute. As one skilled in the art will appreciate, the specific coefficients and form of the algebraic equation will vary from one internal combustion engine to another and are also subject to refined data. Accordingly, the present invention is not limited to the specific coefficients or form of the algebraic expression shown in Equation 1. Other coefficients or algebraic expressions for computing the A/F ratio based on the engine load, the engine speed and the engine exhaust gas temperature are within the spirit and scope of the invention.

Figure 3A:
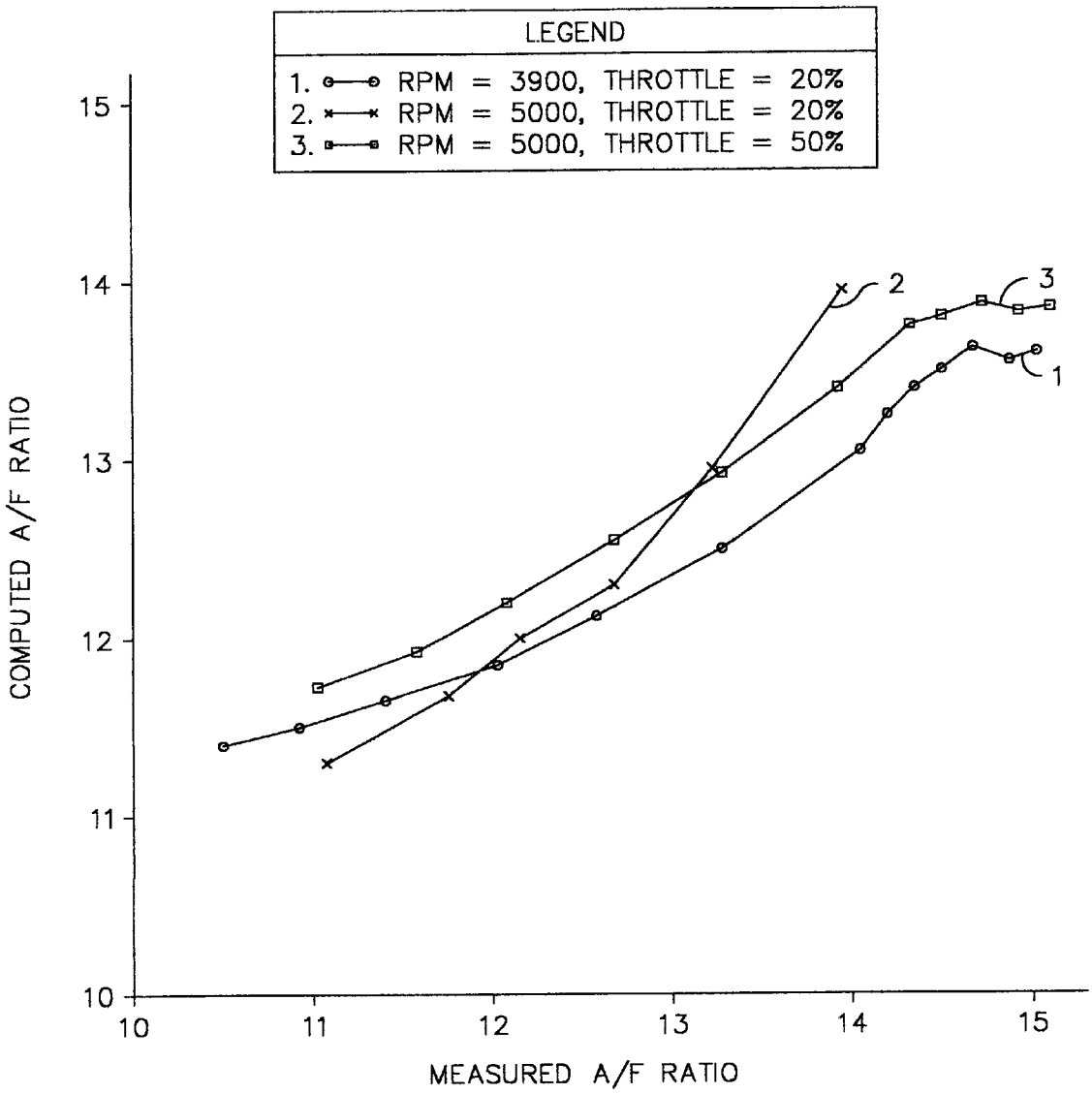
FIG. 3A is a graph showing the value of the A/F ratio computed by the preferred embodiment for different values of the engine speed and the engine throttle position.
Figure 3B:
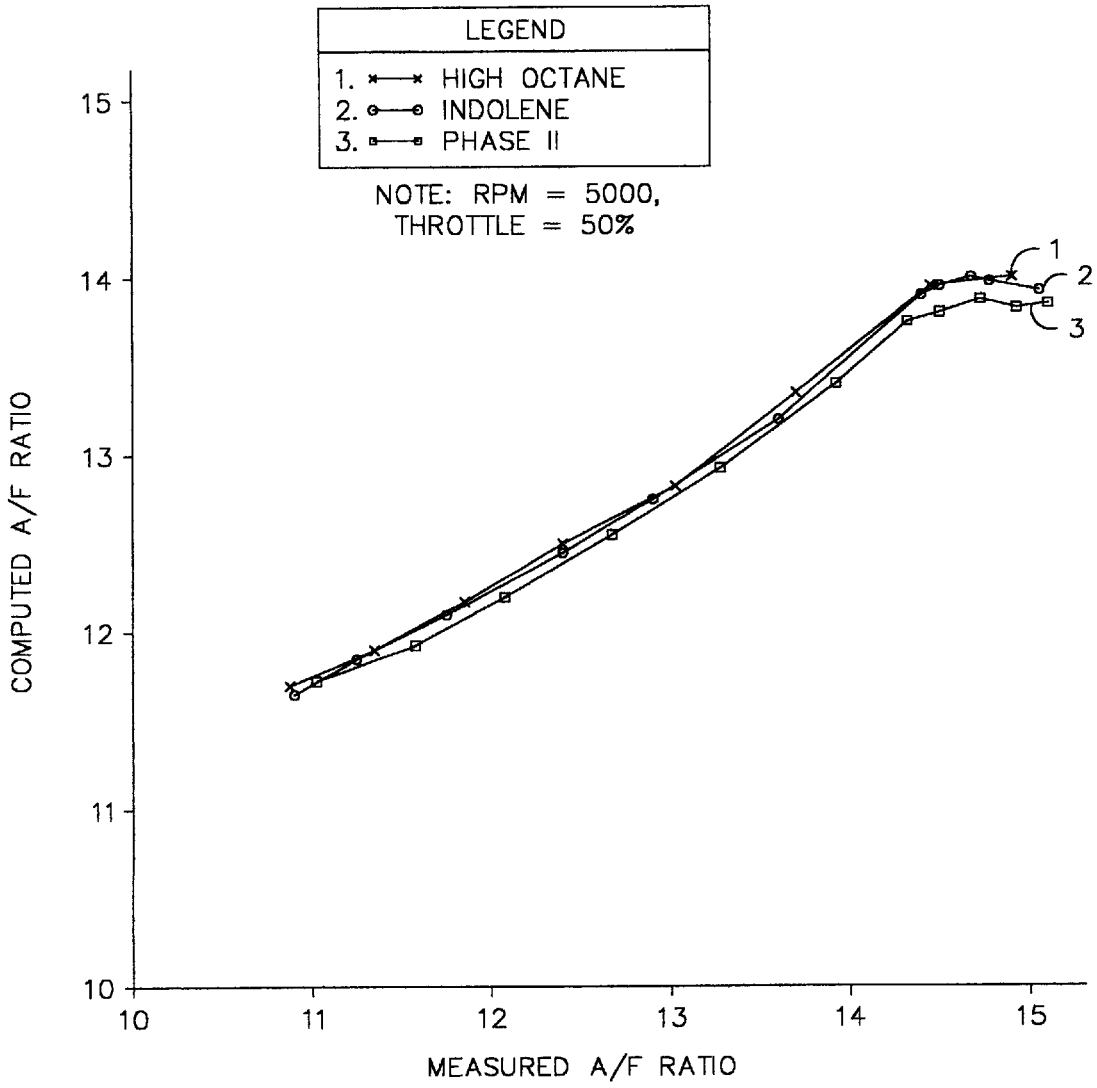
FIG. 3B is a graph showing the value of the A/F ratio computed by the preferred embodiment for different values of the engine speed and the engine throttle position for different kinds of fuel.

FIGS. 3A and 3B depict examples of applying equation (1) to computing the A/F ratio of a 500 cc, one cylinder gasoline engine of a type used in all-terrain vehicles. In FIG. 3A the A/F ratio, as computed by equation (1), is compared with the A/F ratio as measured by a Horiba A/F ratio analyzer for different speed and throttle parameters. In FIG. 3B the A/F ratio, as computed by equation (1), is compared with the A/F ratio as measured by the Horiba A/F ratio analyzer for different types of fuel.

Figure 4:
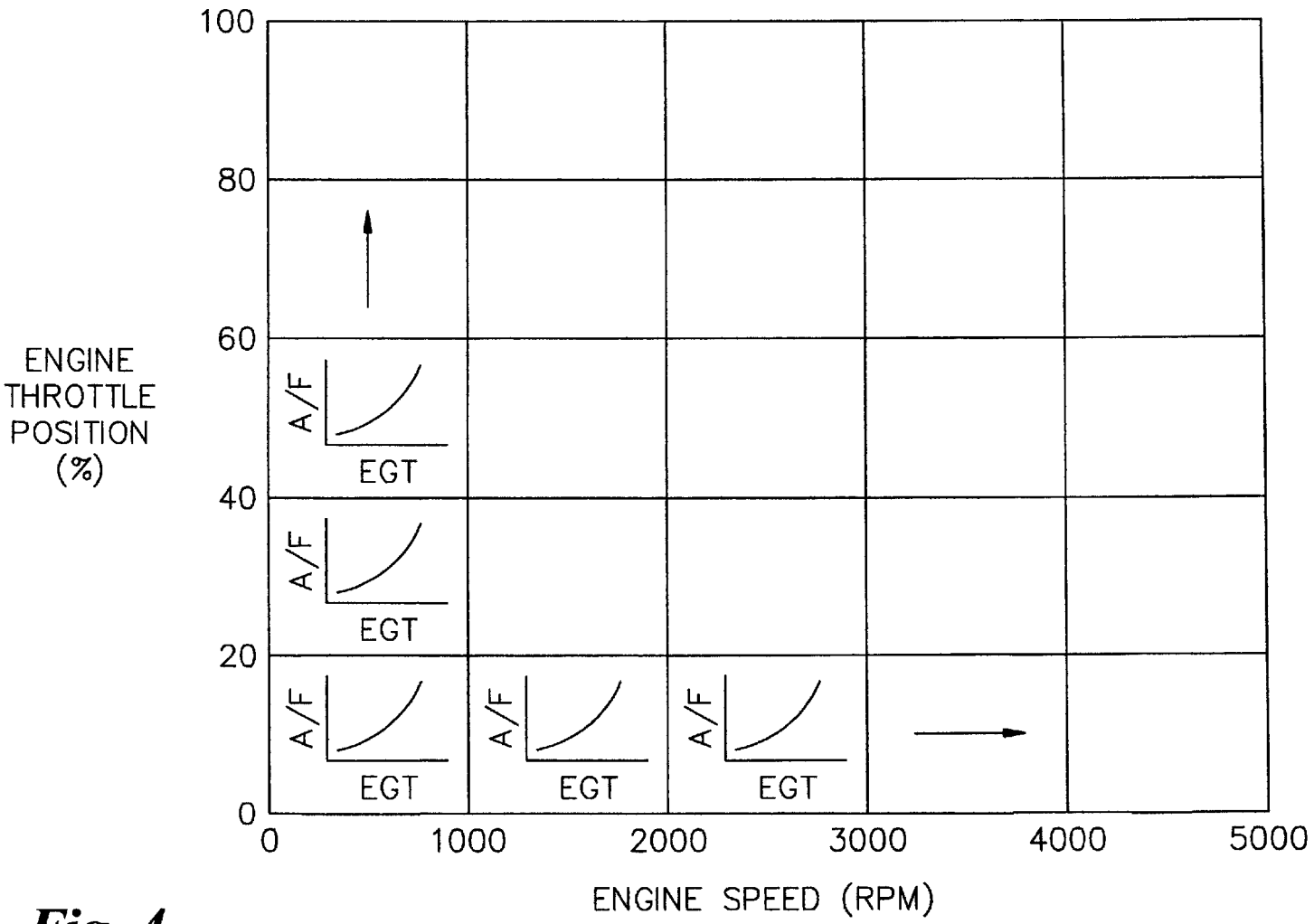
FIG. 4 is a diagram illustrating an alternate A/F ratio computation model.

In an alternate embodiment of the control system 10, a plurality of empirically derived look-up tables, shown diagrammatically in FIG. 4, are stored in non volatile memory for computing the A/F ratio of the engine 14. As shown in FIG. 4, the alternate embodiment includes a plurality of look-up tables, each look-up table covering a predetermined range of the speed of the engine 14 and the throttle position of the engine 14 and each table providing a single value of the A/F ratio for a given value of the exhaust gas temperature. As will be appreciated by those skilled in the art, the A/F ratio may be computed by other methods than from a stored look-up table or an algebraic equation. For example, a neural network could be used to compute the A/F ratio, and is within the spirit and scope of the invention.

In the preferred embodiment, computer executable software code resides in the engine control module 12 for computing the A/F ratio of the engine 14. In the preferred embodiment the software code comprises: information characteristic of the engine 14 providing a relationship between the A/F ratio of the engine 14, the exhaust gas temperature of the engine 14, the speed of the engine 14 and a measured value of a parameter related to the load of the engine 14; code responsive to receiving a measured value of the exhaust gas temperature of the engine 14; code responsive to receiving a measured value of the speed of the engine 14; code responsive to receiving a measured value of a parameter related to the load of the engine 14; code for computing the A/F ratio of the engine 14 based on the measured exhaust gas temperature, the measured speed of the engine 14, the measured value of a parameter related to the load of the engine 14 and the information relating the A/F ratio of the engine 14, the exhaust gas temperature of the engine 14, the speed of the engine 14 and the parameter related to the load of the engine 14. The software code further includes the plurality of predetermined values of the A/F ratio; code for comparing the computed A/F ratio with one of the plurality of predetermined values of the A/F ratio; and code for generating A/F ratio control signals based on the difference between the computed A/F ratio and the one of the plurality of predetermined values. As will be appreciated by those skilled in the art, the computer executable software code need not reside in the engine control module 12 but could reside in a separate device. Further, the computation of the A/F ratio could be implemented by other means than by the stored executable software code. For instance the A/F ratio could be computed by hard wired logic implemented by discrete electronic components or by an application specific integrated circuit (ASIC) or a combination of all of the above, and still be within the spirit and scope of the invention.

Figure 5:
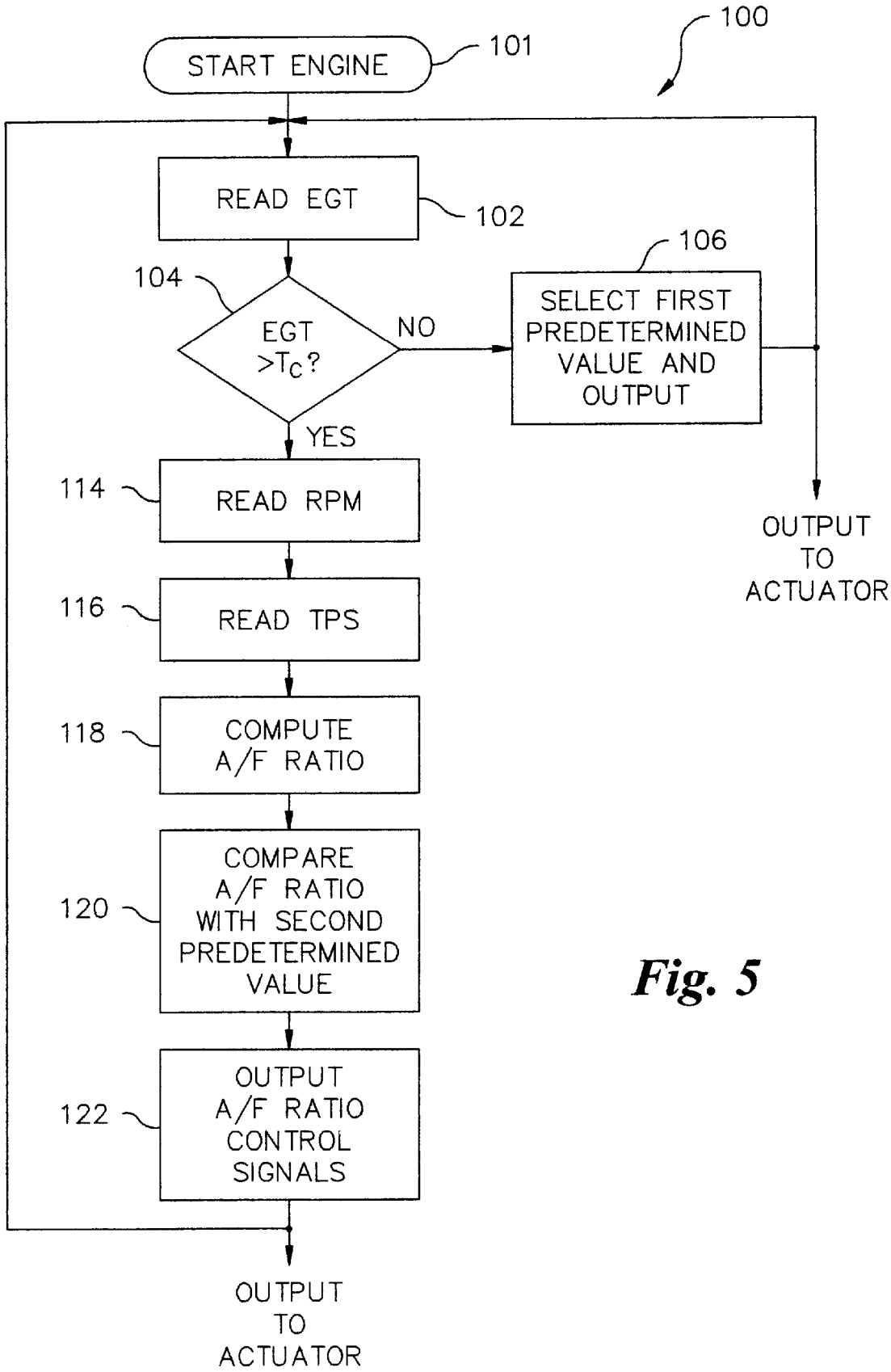
FIG. 5 is a flow diagram of a preferred method for setting the A/F ratio of the internal combustion engine according to the present invention.

Referring now to FIG. 5 there is shown a flow diagram of a preferred method 100 for controlling the A/F ratio of an engine 14 in accordance with the present invention. Subsequent to activating the ignition of the engine 14 at step 101, the exhaust gas temperature from the EGT sensor 20 is read into the controller 12 at step 102. If at step 104 the measured exhaust gas temperature is determined to be less than or equal to a predetermined temperature, Tc, typically in the vicinity of 750° C., the engine 14 is determined to be cold and the controller 12, at step 106, outputs A/F ratio control signals 50 to the actuators 32 to control the A/F ratio to be substantially equal to the first predetermined value of the A/F. Note that in the preferred method, the control of the engine A/F ratio is open loop when the exhaust gas temperature is less than or equal to Tc.

In accordance with the flowchart of FIG. 5, the controller 12 continues to read the exhaust gas temperature at step 102 and to compare the exhaust gas temperature with Tc at step 104 until the exhaust gas temperature is determined to be greater than Tc. When the exhaust gas temperature is determined to be greater Tc, the controller 12 selects the second predetermined value of the A/F ratio as a control set point for closed loop control of the A/F ratio. The output of the engine speed sensor 30 is read into the controller 12 at step 114 and, the output of the throttle position sensor 28 is read into the controller 12 at step 116. At step 118, the controller 12 computes the A/F ratio of the engine 14 using the stored information characteristic of the engine 14 and the measurements of the exhaust gas temperature, the engine speed and the throttle position. At step 120 the A/F ratio computed by the controller 12 is compared with the second predetermined value of the A/F to generate the A/F ratio control signals 50. At step 122, the A/F ratio control signals 50 are output to the A/F ratio actuators 32. In the preferred method, the computer program continues to loop through step 102 at a rate of approximately ten iterations per second in order to maintain the A/F ratio of the engine 14 at either of the first or the second predetermined values. As will be clear to those skilled in the art, the present invention is not limited to controlling the A/F ratio to the first and the second predetermined values of A/F ratio nor to the particular control scheme illustrated in FIG. 5. Other engine 14 control schemes, the basis of which is the computation of the A/F ratio from the exhaust gas temperature, the speed and the load of the engine, are within the spirit and scope of the invention.

It will be appreciated by those skilled in the art that changes could be made to the embodiments described above without departing from the broad inventive concept thereof. For instance, the invention is not limited to lawnmower and marine engines, but is equally applicable to the operation of any internal combustion engine for which the A/F ratio of the engine 14 is to be determined. It is understood, therefore, that this invention is not limited to the particular embodiments disclosed, but it is intended to cover modifications within the spirit and scope of the present invention as defined by the appended claims.

I claim:

1. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the measured parameter related to the load is a mass air flow of the engine.

2. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the measured parameter related to the load is a throttle position of the engine.

3. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the measured parameter related to the load is a ratio of compression to expansion stroke time duration of the engine.

4. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the measured parameter related to the load is an intake manifold pressure of the engine.

5. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the information characteristic of the engine is stored in the form of a plurality of empirically derived look-up tables, each table covering a predetermined range of the engine speed and the parameter related to the load of the engine and providing a single value of the A/F ratio for a given value of the exhaust gas temperature.

6. A method using a computer for determining an air-to-fuel (A/F) ratio of an internal combustion engine, wherein information characteristic of the engine relating the A/F ratio of the engine, an exhaust gas temperature of the engine, a speed of the engine and a parameter related to a load of the engine is previously stored in the computer, the method comprising the steps of:

measuring the exhaust gas temperature;

measuring the speed;

measuring the parameter related to the load;

computing the A/F ratio based on the previously stored information, the measured exhaust gas temperature, the measured speed and the measured parameter related to the load; and outputting a signal representative of the A/F ratio, wherein the information characteristic of the engine is stored as a set of coefficients of an empirically derived algebraic expression, the algebraic expression having the exhaust gas temperature, the speed and the parameter related to load as variables.

7. A system for determining an air-to-fuel (A/F) ratio of an internal combustion engine, the system comprising:

a memory for storing information characteristic of the engine relating the A/F ratio, an exhaust gas temperature, a speed and a parameter related to a load of the engine;

a sensor for measuring the exhaust gas temperature of the engine;

a sensor for measuring the speed of the engine;

a sensor for measuring the parameter related to the load of the load of the engine; and a computer for determining the A/F ratio from a computation based on the stored engine information, the measured exhaust gas temperature, the measured engine speed and the measured parameter related to the engine load and for outputting a signal representative of the A/F ratio, wherein the sensor for measuring the parameter related to the engine load comprises a mass air flow sensor.

8. A system for determining an air-to-fuel (A/F) ratio of an internal combustion engine, the system comprising:

a memory for storing information characteristic of the engine relating the A/F ratio, an exhaust gas temperature, a speed and a parameter related to a load of the engine;

a sensor for measuring the exhaust gas temperature of the engine;

a sensor for measuring the speed of the engine;

a sensor for measuring the parameter related to the load of the load of the engine; and a computer for determining the A/F ratio from a computation based on the stored engine information, the measured exhaust gas temperature, the measured engine speed and the measured parameter related to the engine load and for outputting a signal representative of the A/F ratio, wherein the sensor for measuring the parameter related to the engine load comprises a throttle position sensor.

9. A system for determining an air-to-fuel (A/F) ratio of an internal combustion engine, the system comprising:

a memory for storing information characteristic of the engine relating the A/F ratio, an exhaust gas temperature, a speed and a parameter related to a load of the engine;

a sensor for measuring the exhaust gas temperature of the engine;

a sensor for measuring the speed of the engine;

a sensor for measuring the parameter related to the load of the load of the engine; and a computer for determining the A/F ratio from a computation based on the stored engine information, the measured exhaust gas temperature, the measured engine speed and the measured parameter related to the engine load and for outputting a signal representative of the A/F ratio, wherein the sensor for measuring the parameter related to the engine load comprises an intake manifold air pressure sensor.

10. Computer executable software code stored on a computer readable medium, the code for computing an air-to-fuel (A/F) ratio of an internal combustion engine, the software code comprising:

information characteristic of the engine relating the A/F ratio, an exhaust gas temperature, an engine speed and a parameter related to an engine load;

code responsive to receiving a measurement of the exhaust gas temperature of the engine;

code responsive to receiving a measurement of the engine speed;

code responsive to receiving a measurement of the parameter related to the engine load; and code for computing the A/F ratio based on the measured exhaust gas temperature, the measured engine speed, the measured parameter related to the engine load and the information relating the A/F ratio, the engine exhaust gas temperature, the engine speed and the parameter related to the engine load, wherein the information is stored in the form of a plurality of empirically derived look-up tables, each table covering a predetermined range of the speed of the engine and the parameter related to the load of the engine and providing a single value of the A/F ratio for a given value of the exhaust gas temperature, the software code determining the A/F ratio by selecting one of the plurality of tables based on the measured speed of the engine and the measured parameter related to the load of the engine, and thereafter determining the A/F ratio from the value of the measured exhaust gas temperature.

11. The software code according to claim 10 wherein the parameter related to the load of the engine is a position of a throttle.

12. Computer executable software code stored on a computer readable medium, the code for computing an air-to-fuel (A/F) ratio of an internal combustion engine, the software code comprising:

information characteristic of the engine relating the A/F ratio, an exhaust gas temperature, an engine speed and a parameter related to an engine load;

code responsive to receiving a measurement of the exhaust gas temperature of the engine;

code responsive to receiving a measurement of the engine speed;

code responsive to receiving a measurement of the parameter related to the engine load; and code for computing the A/F ratio based on the measured exhaust gas temperature, the measured engine speed, the measured parameter related to the engine load and the information relating the A/F ratio, the engine exhaust gas temperature, the engine speed and the parameter related to the engine load, wherein the information is stored as a set coefficients of an empirically derived algebraic expression, the software determining the A/F ratio by solving the algebraic expression using the coefficients in combination with the measured values of the exhaust gas temperature, the measured speed of the engine and the measured parameter related to the load of the engine.

13. The software code according to claim 12 wherein the parameter related to the load of the engine is a position of a throttle.

* * * * *